United States Patent [19]

Beckmann et al.

[11] Patent Number: 4,846,849

[45] Date of Patent: Jul. 11, 1989

[54] METHOD OF FLUE STREAM HEATING

[75] Inventors: Franz Beckmann, Würselen; Matthias Ferner, Alsdorf, both of Fed. Rep. of Germany; Armand Wagner, Esch/Alzette, Luxembourg

[73] Assignee: Laborlux S.A., Luxembourg, Luxembourg

[21] Appl. No.: 104,887

[22] Filed: Oct. 6, 1987

[30] Foreign Application Priority Data

Oct. 6, 1986 [LU] Luxembourg ..... 86622

[51] Int. Cl.[4] ..... C10L 5/08

[52] U.S. Cl. ..... 44/593; 44/599; 44/12; 44/550

[58] Field of Search ..... 44/1 F, 10 C, 26, 550, 44/593, 592, 605, 606, 12, 599

[56] References Cited

U.S. PATENT DOCUMENTS

| | | | |
|---|---|---|---|
| 764,986 | 7/1904 | Bulask | 44/26 |
| 2,937,080 | 5/1960 | Komarek et al. | 44/10 |
| 4,059,412 | 11/1977 | Goossens et al. | 44/10 C |
| 4,345,914 | 8/1982 | Rammler | 44/10 C |

FOREIGN PATENT DOCUMENTS

| | | | |
|---|---|---|---|
| 1571711 | 8/1972 | Fed. Rep. of Germany . | |
| 14219 | of 1905 | United Kingdom | 44/26 |
| 650881 | 3/1951 | United Kingdom | 44/26 |
| 1221735 | 2/1971 | United Kingdom | 44/26 |

*Primary Examiner*—Patrick P. Garvin

*Assistant Examiner*—George R. Fourson

*Attorney, Agent, or Firm*—Fleit, Jacobson, Cohn, Price, Holman & Stern

[57] ABSTRACT

Fine-grained substances which do not soften below 800° C., such as oil coke, coking duff, pitch coke and/or fine-grained coal with less than 14% volatile constituents, sand, ores, metal oxides, metals or mixtures of such substances, are introduced in at least two places into a carrier gas stream and are thermally heated to 550–650° C. in the solid discharge of a first cyclone. Then the same carrier gas stream heats coking coal amounting to 18–38% of the intended briquettable product material to 200–400° C. in the solid discharge of a second cyclone. The two solid flows are mixed and treated, producing the briquettable material at 500±50° C. The carrier gas stream is produced by the combustion of liquid and/or gaseous fuels with an excess air factor of 2 or more. Thermally inert, low-ash solid fuels, such as oil coke, pitch coke and/or low-ash, fine-grained, low-volatility coal, amounting to 20–40% of the briquetting material, are initially introduced. The oxygen of the excess air is reacted mainly with these initally introduced low-ash solid fuels and their volatile pyrolysis products. Then additional fine-grained, thermally inert substances are introduced into at least one position of the flue stream situated downstream, and are heated before being separated in the first cyclone, while the carrier gas is cooled to a temperature of 750±75° C. before the introduction of the coking coal.

13 Claims, No Drawings

METHOD OF FLUE STREAM HEATING

BACKGROUND OF THE INVENTION

1. Field of Invention

The invention relates to a method of flue stream heating fine-grained, thermally inert substances, in order to produce a briquetting material.

2. Description of Prior Art

German Pat. No. 1 571 711 discloses a method of producing fuel briquettes, in which thermally inert substances, such as for example coking duff, lean fine coal, ore, limestone, sand, and raw phosphate, are used, and treated with coking coal which softens at a high temperature, as a binding agent.

This hot briquetting method is known in the technical literature as the Ancit method. The state of the art is reproduced in the research Report T 82-144 of the Federal Ministry of Research and Technology of the Federal Republic of Germany.

According to the state of the art the mixing and briquetting temperature is about 500° C. The charging components consist of, on the one hand, 72±10% of fine-grained substances which do not soften below 800° C., i.e. thermally inert substances, such as oil coke, coking duff (grit), pitch coke and/or fine-grained coal with less than 14% volatile constituents, sand, ores, metal oxides, metals, industrial dust, or mixtures of such substances, and, on the other hand, 18±10% of coking coal. The components are heated in the flue stream. The carrier gas is produced in a combustion chamber arranged upstream of the flue stream reactor by as nearly as possible stoichiometric combustion of gaseous and/or liquid fuels. In the Ancit method the two components are introduced successively into the carrier gas, are heated, and are separated again from the carrier gas with the aid of cyclones.

The hot, inert substances at 550° to 650° C. (proportions of 72±10%) are mixed with the coking coal heated to 200° to 400° C. (proportions of 18±38%) and are partially degassed and briquetted, in particular at a temperature of 500°±50° C.

The heat requirement of the method is considerable and furthermore cannot be covered by process heat. This is due to two reasons, namely that caking of slags occurs in the first flue stream reactor and, in addition, the softening temperature is exceeded in the second cyclone. The latter circumstance has also made it impossible hitherto, when hot-briquetting low-ash, solid fuels, to cover more than $\frac{1}{3}$ of the process heat by burning off in the flue stream cloud.

SUMMARY OF THE INVENTION

The object of this invention is to provide a method with the aid of which the process gas or oil consumption of the conventional Ancit method can be reduced by at least half.

The invention provides the following method.

Fine-grained substances not softening below 800° C., i.e. thermally inert substances, such as oil coke, coking duff, pitch coke and/or fine-grained coal with less than 14% volatile constituents, sand, ores, metal oxides, metals, or mixtures of such substances, are introduced in at least two places in the carrier gas stream and are heated to temperatures of between 550° and 650° C. in the solid discharge of a first separating cyclone. After that, in the second flue stream reactor which is traversed by the same carrier gas stream, coking coal with a proportion of 18 to 38% of the mass to be heated is heated to temperatures of between 200° and 400° C. in the solid discharge of a second separating cyclone.

This is followed by mixing of the two solid flows and conditioning them for producing a briquetting material for the briquetting which immediately follows, at temperatures of 500°±50° C.

The main features of the method are as follows:

(a) in the carrier gas stream, which is produced by the combustion of liquid and/or gaseous fuels with an excess air factor, or excess coefficient, of at least 2, thermally inert, low-ash solid fuels, such as oil coke, pitch coke and/or low-ash, fine-grained, low-volatility coal with a proportion of 20 to 40% of the briquetting material, are initially introduced;

(b) the oxygen of the excessive combustion air is reacted mainly with these initially introduced low-ash solid fuels and their volatile pyrolysis products;

(c) additional fine-grained, thermally inert substances are introduced into at least one position of the flue stream situated downstream, and are heated and together with the substances named in (a) are separated from the carrier gas in the first cyclone, the carrier gas being cooled to a temperature of 750°±75° C. before the introduction of the coking coal.

Further optional and preferred features of the method are set out in Sub-Claims 2 et seq.

Accordingly:

a minimum distance, which is sufficient to reduce substantially the excess oxygen of the carrier gas by reactions with the initially introduced low-ash solid fuels, is observed between the two or more charging positions for the inert component or components;

the hot carrier gas is then cooled to 750°±75° C. before the introduction of the coking coal, by the addition of further inert substances;

the oxygen residue from the combustion chamber and blown air is consumed by reaction with the gaseous fuels formed by pyrolysis and gasification before blowing in the coking coal.

Whereas it has been established in earlier tests of brief duration that a saving in process gas of up to a third of the necessary heat requirement is accompanied by a reduction in the waste heat of approximately the same amount of heat, in the case of the higher excess air figures according to the invention, namely 2 and over, in the combustion chamber (corresponding to a saving in process gas of 50% and over) the reduction in the waste heat is less. In addition, when blowing hot air as a carrier gas into the flue stream reactor and with a complete saving of an additional gaseous or liquid process fuel, a fuel value of approximately 1 $MJ/m^3$ remains in the waste gas.

When the hot carrier gas is cooled to 750°±75° C. before the introduction of the coking coal by blowing in additional inert substances which are then separated—at 550° to 650° C. —together with the low-ash fuel initially introduced into the oxygen-containing carrier gas in the first cyclone, no deposits of slag are formed. This is true even when the additional inert substances are not fuels.

In this way, sand, ores, metal oxides, phosphates, quicklime, industrial dust—e.g. the residues of the steel industry—and/or similar fine-grained substances or mixtures of such substances can thus be bonded into carbonaceous hot briquettes.

DETAILED DESCRIPTION (1) A carrier gas stream is produced by burning a gaseous fuel in air, with an air excess factor of 2 or more. The air excess factor can be increased by using hot combustion air.

(2) The hot carrier gas stream traverses a first flue stream reactor. At a first position in the reactor thermally inert, low-ash solid fuels, such as oil coke, pitch coke, and/or low-volatility coal, are introduced in an amount equivalent to 20 to 40% of the briquetting material to be produced. Most of the oxygen of the excess air in the combustion gas stream then reacts exothermically with these fuels and their volatile pyrolysis products.

(3) At one or more positions downstream of the first position, additional fine-grained, thermally inert substances are introduced into the carrier gas stream so that they are heated up while the hot carrier gas cools to 750°±75° C.

(4) The solids are separated from the carrier gas stream in a first cyclone, leaving it at 550° to 650° C.

(5) Then, in a second flue stream reactor, traversed by the carrier gas stream previously cooled to 750°±75° C., coking coal is introduced in an amount equivalent to 18 to 38% of the briquetting material to be produced. The coking coal heats up while the carrier gas stream cools down.

(6) The heated coking coal is separated in a second cyclone, leaving it at 200° to 400° C., whereupon it is mixed with the solids from the first cyclone and the mixture suitably treated to produce a material which is at 500° to 50° C. and suitable for immediate briquetting.

(7) The low-temperature carbonization gas formed during the mixing and treatment of the material and/or during the subsequent hardening of the raw heat briquettes may be used as a fuel gas in stage (1) of the process, optionally after condensation and separation of low-temperature carbonization tar but not condensation of the water of distillation. The sensible and latent heat of the carrier gas leaving the second cyclone may be used for heating the combustion air.

If additional thermally inert, fine-grained carbon carriers such as oil coke, pitch coke, coking duff, anthracite and/or lean coal are introduced in stage (3), then in the subsequent briquetting a molded member can be produced which burns in a smoke-free manner and which where appropriate acquires the solidity of coke by subsequent hardening at briquetting temperature according to the known method or is converted into a molded coke by subsequent coking.

If quartz sand—where appropriate with additional low-ash carbon carriers such as oil coke—is introduced in stage (3), then in the subsequent briquetting one can produce an intermediate product for obtaining crude silicon in an electric furnace.

In addition to quartz sand and where appropriate additional low-ash carbon carriers, if fine-grained metal compounds and/or metal particles are introduced in stage (3), then in the subsequent briquetting one can produce an intermediate product for obtaining silicon alloys.

Finally, if iron ores and/or fine-grained residues of the steel industry, such as flue dust, converter dust, and rolling scale, where appropriate with additional carbon carriers are introduced in stage (3), the hot briquettes eventually produced may be fed to a sintering belt, a blast furnace, or a steel converter.

We claim:

1. A method of producing material for briquetting, comprising the sequential steps of:

(a) producing a carrier gas stream as a combustion product of burning fluid fuel in air wherein the amount of air is at least twice that required for theoretically complete combustion of the fuel;

(b) introducing into said carrier gas stream at a first position at least one fine-grained, low-ash solid fuel, which is thermally inert by not softening below 800 degree C, in an amount of 20 to 40% of the weight of the briquetting material to be produced;

(c) reacting oxygen in the excess air of said carrier gas stream mainly with said solid fuel and pyrolysis products therefrom;

(d) introducing at least one additional fine-grained, thermally inert substance into said carrier gas stream in at least one position downstream of said first position and heating said additional substance by said carrier gas stream;

(e) separating resulting solids from said carrier gas stream in a first separating cyclone and discharging said solids from said first cyclone at 550 to 650 degrees C. while conducting said carrier gas stream, cooled to 750±75 degrees C., to a second separating cyclone;

(f) introducing coking coal into said carrier gas stream being conducted to said second separating cyclone in an amount of 18 to 38% of the weight of said briquetting material to be produced;

(g) separating resulting heated solids from said carrier gas stream in said second separating cyclone and discharging said solids from said second cyclone at 200 to 400 degrees C; and (h) mixing said solids discharged from said first and second cyclones to produce a material at 500±50 degrees C. which is directly briquettable.

2. A method as claimed in claim 1 wherein at least one fine-grained, thermally inert carbon carrier is introduced in step (d).

3. A method as claimed in claim 1 wherein quartz sand is introduced in step (d).

4. A method as claimed in claim 3, wherein at least one thermally inert, low-ash carbon carrier is introduced in step (d).

5. A method as claimed in claim 1 wherein quartz sand and at least one thermally inert substance selected from the group consisting of fine-grained metal compounds and metal particles are introduced in step (d).

6. A method as claimed in claim 5, wherein at least one themally inert, low-ash carbon carrier is introduced in step (d).

7. A method as claimed in claim 1 wherein fine-grained, thermally inert substances selected from the group consisting of iron ores and steel industry residues are introduced in step (d).

8. A method as claimed in claim 7 wherein a thermally inert, fine-grained carbon carrier is introduced in step (d).

9. A method as claimed in claim 1 and further comprising:

producing gas from low-temperature carbonization during step (h); and introducing said produced gas as fluid fuel in step (a).

10. A method as claimed in claim 1 wherein said gas is introduced in step (a) after condensation and separation of low temperature carbonization tar therefrom, without condensation of water.

11. A method as claimed in claim 1 and further comprising:

using the sensible and latent heat of said carrier gas stream, after said second cyclone, for air heating.

12. A method as claimed in claim 1 and further comprising:

increasing the amount of excess air by addition of hot combustion air.

13. A method as claimed in claim 1 and further comprising:

producing gas from low-temperature carbonization after step (h); and introducing said produced gas as fluid fuel in step (a).

* * * * *